US005457977A

United States Patent [19]

Wilson

[11] Patent Number: 5,457,977

[45] Date of Patent: Oct. 17, 1995

[54] METHOD AND APPARATUS FOR REFORMING A TUBE

[75] Inventor: Gerald L. Wilson, Wayland, Mass.

[73] Assignee: Carrier Corporation, Syracuse, N.Y.

[21] Appl. No.: 274,526

[22] Filed: Jul. 13, 1994

[51] Int. Cl.[6] ..... B21D 26/14

[52] U.S. Cl. ..... 72/56; 72/430; 29/419.2

[58] Field of Search ..... 72/54, 56, 430; 29/419.2

[56] References Cited

U.S. PATENT DOCUMENTS

| | | | |
|---|---|---|---|
| 3,187,532 | 6/1965 | Furth | 72/56 |
| 3,345,732 | 10/1967 | Brower | 72/56 |
| 3,599,461 | 8/1971 | Astl | 72/56 |
| 3,599,462 | 8/1971 | Kline | 72/56 |
| 3,618,350 | 11/1971 | Larrimer, Jr. et al. | 72/56 |
| 4,285,224 | 8/1981 | Shkatov et al. | 72/56 |
| 4,619,127 | 10/1986 | Sano et al. | 72/56 |
| 4,947,667 | 8/1990 | Gunkel et al. | 72/56 |
| 4,962,656 | 10/1990 | Kunerth et al. | 72/56 |
| 5,331,832 | 7/1994 | Cherian et al. | 72/56 |
| 5,353,617 | 10/1994 | Cherian et al. | 72/56 |

*Primary Examiner*—David Jones

[57] ABSTRACT

A method and apparatus for reforming, by either radially expanding or reducing an electrically conductive tubular workpiece (11). The method of the expansion embodiment comprises the steps of inserting an insulated electrical conductor (21) into the tube; then making up an electrical circuit that includes the portion of the wall of the tube in series or parallel connection with the electrical conductor and a source of electrical power (C and SW), then applying a voltage across the circuit. The current flowing through the conductor and the tube produces a circumferential electromagnetic field between the conductor and the tube. The current in the tube, interacting with the magnetic field, produces a radially directed outward force on the tube. If the force is sufficiently great and of a duration longer than the time required for a sound wave to pass through the tube wall, the tube wall will radially expand and be permanently deformed. The method of the reduction embodiment comprises the additional step of inserting the workpiece in an electrically conductive sleeve (51) and the making up step comprises including the sleeve in the electrical circuit and arranging the workpiece and the conductor in parallel circuit relationship. The respective apparatus of the two embodiments implement the method of the invention. The expansion embodiment of the invention is particularly adapted to the expansion of tubes in plate fin and tube type heat exchangers.

14 Claims, 3 Drawing Sheets

METHOD AND APPARATUS FOR REFORMING A TUBE

BACKGROUND OF THE INVENTION

This invention relates generally to the field of metal working. More particularly, the invention relates to a method and apparatus for expanding or reducing a tubular workpiece by means of a high intensity magnetic field. The invention has a variety of applications including the manufacture of plate fin and tube heat exchangers.

Plate fin and tube type heat exchangers are widely used, particularly in engine cooling, air conditioning and refrigeration systems. Such a heat exchanger comprises a plurality of tubes through which a fluid, for example water or a refrigerant, flows. Another fluid, for example air, flows over the external surfaces of the tubes. Heat transfers between the internal and external fluids through the walls of the tubes. One factor that affects the rate of heat transfer between the fluids is the surface area of the tube that is in contact with the external fluid. One means commonly used to increase external surface area is to add plate fins to the tube. A plate fin is a strip or sheet of relatively thin material, usually metal, having holes through which the tubes of the heat exchanger pass. To be effective in improving the heat transfer performance of the heat exchanger, the plate fins must be in good physical contact with the tubes. During construction of a plate fin and tube heat exchanger, the holes in the plate fin are made with a diameter that is slightly larger than the outer diameter of the tubes. Then, after the fins are "laced" on to the tubes, the tubes are expanded radially to achieve a close mechanical fit with the fins.

There are a number of prior an methods of expanding tubes. One common method is mechanically, in which an expander tool is driven by some means, usually a rod, through the tube. The expander tool has an outer diameter that is larger than the inner diameter of the tube, so that driving the tool through enlarges the tube outer diameter sufficiently to make good contact with the fins. Frequently, the internal surface of a heat exchanger tube is not smooth but has some type of surface enhancement that serves to increase the internal surface area and promote fluid flow so as to improve the heat transfer performance of the tube. The expander tool used in mechanical expansion can damage the internal surface enhancement. During mechanical tube expansion, not only is the tube diameter increased but also the length of the tube decreases. The amount of the decrease varies so that after expansion, tubes that originally were all the same length can have different lengths. In making heat exchangers, this can present difficulties in subsequent manufacturing steps.

Advances in the heat exchanger art have led to the increasing use of relatively small diameter tubes. The diameter of the rod used to drive the expander tool in mechanical expansion apparatus must necessarily be smaller than the inner diameter of the tube being expanded. As tube diameters have decreased, the maximum allowable diameter of the expander rod has necessarily also decreased. As the expander rod diameter decreases, the likelihood of its buckling during an expansion operation increases. With the tube diameters now in consideration for use in heat exchangers, mechanical expansion using a rod-driven expander may not be possible. What is needed is a means for expanding very small diameter tubes.

In other manufacturing processes, there may be a requirement to reduce the diameter of a tube, such as joining a tube of one diameter to a tube of a smaller diameter.

U.S. Pat. No. 4,285,224, issued 25 Aug. 1981 to Shkatov et al., discloses an Electric Pulse Tube Expander. The Shkatov apparatus uses an "electric fuse" that explodes when an electric pulse is applied. The resultant shock wave acts through a filler in the fuse to cause the wall of the tube to expand. The Shkatov disclosure does not contain information regarding the aftermath of the explosion but it is probable that at least a certain amount of debris from the expansion process remains inside the tubes. Such debris must be removed from the tubes after expansion and before sealing the completed heat exchanger into a refrigeration or cooling system.

U.S. Pat. No. 4,947,667, issued 14 Aug. 1990 to Gunkel et al., for example discloses a Method and Apparatus for Reforming a Container. The Gunkel disclosure describes an apparatus and process for expanding selected portions of a cylindrical metal body using electromagnetic force. The Gunkel process requires a retainer. The Gunkel electrical circuit that generates the electromagnetic field does not include the workpiece.

SUMMARY OF THE INVENTION

The present invention is a method for reforming, either by expansion or reduction, a tubular workpiece as well as an apparatus for practicing the method. The invention is capable of use to expand metallic, e.g. copper, tubes of relatively small diameter. With minor modifications, one can use the method and apparatus of the invention to reduce the diameter of a tube.

In the expansion embodiment, the method comprises the steps of inserting an insulated electrical conductor into the tubular workpiece; then making up an electrical circuit that includes the portion of the wall of the workpiece to be expanded, the electrical conductor and a source of electrical power, then applying a high voltage through the circuit. The current through the conductor and the workpiece produces a circumferential electromagnetic field between the conductor and the workpiece. The current, interacting with the magnetic field, produces a radially directed outward force on the workpiece. If the force is sufficiently great, the workpiece wall will radially expand and be permanently deformed.

In the reduction embodiment, the method comprises the steps of inserting an insulated electrical conductor into the tubular workpiece; then inserting the workpiece into an electrically conductive tubular sleeve that surrounds the workpiece; then making up an electrical circuit that includes the tubular sleeve, the electrical conductor and a source of electrical power; then making up an electrical circuit that includes the portion of the wall of the workpiece to be reduced, the tubular sleeve and a second source of electrical power, then applying high voltages through both circuit legs. The current flow through the conductor, the workpiece and the tubular sleeve produces a circumferential electromagnetic field around the conductor, the workpiece and the sleeve. The current, interacting with the magnetic field, produces a radially directed inward force on the workpiece. If the force is sufficiently great, the workpiece wall will radially reduce and be permanently deformed.

In the expansion embodiment, the direction of current flow through the workpiece is opposite the direction of current flow in the conductor. It is for this reason that the force produced is directed radially outward. In the reduction embodiment, the direction of current flow through the workpiece is the same as the direction of current flow through the conduction. It is for this reason that force produced is directed radially inward.

The current generated must be great enough to produce a force of magnetic origin of sufficient strength to deform the workpiece. In the reduction embodiment, two electrical pulses are used. The field strength is proportional to the product of the currents in two different legs of the circuit used. The duration of the voltage, and hence the current, pulse or pulses must be sufficiently short that the heat generated by the current flow is not great enough to melt the workpiece.

The energy produced by the magnetic field travels through the material in the workpiece wall as a pressure wave in the same way that a sound wave travels through the material. The duration of the pulse must be sufficiently long to allow the wave to pass through the wall.

BRIEF DESCRIPTION OF THE DRAWINGS

The accompanying drawings form a part of the specification. Throughout the drawings, like reference numbers identify like elements.

DESCRIPTION OF THE PREFERRED EMBODIMENTS

Figure 1:
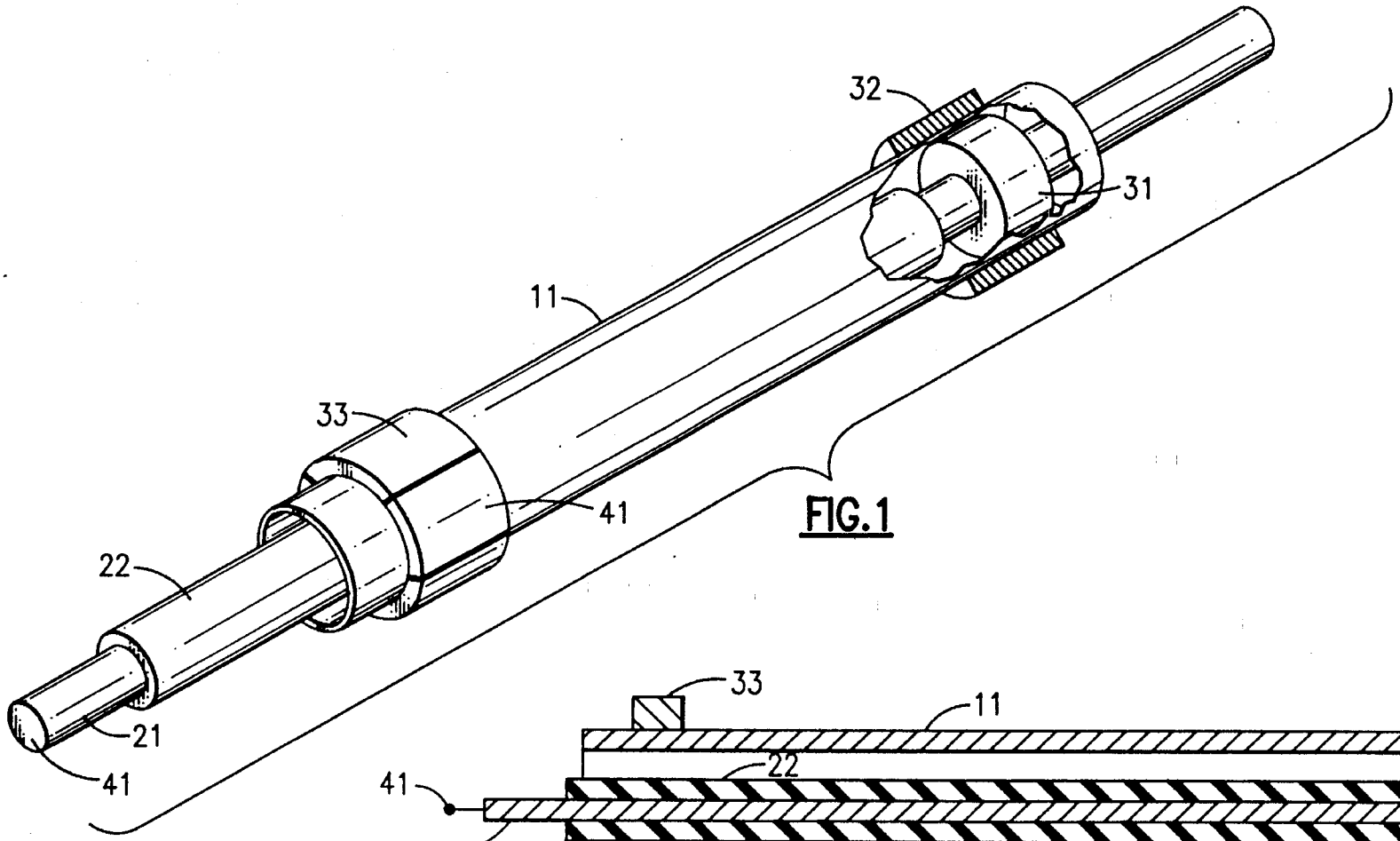
FIG. 1 is a perspective view, partially broken away, of part of the apparatus of one embodiment of the present invention.
Figure 2:
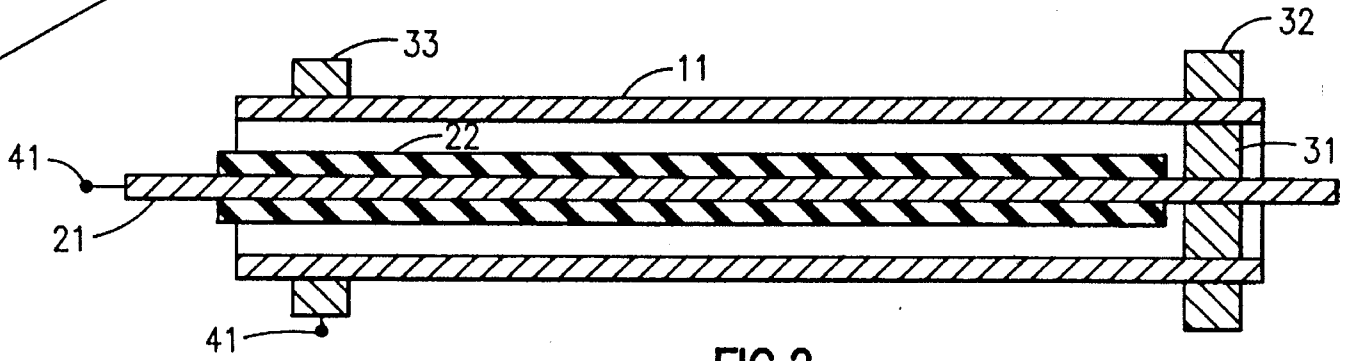
FIG. 2 is a sectioned elevation view of part of the apparatus of a first embodiment of the present invention.

FIGS. 1 and 2 depict, in respectively a perspective view and a sectioned elevation view, part of the apparatus of the expansion embodiment of the present invention. Passing through tubular workpiece 11 is electrical conductor 21. Insulation 22 covers conductor 21 over most of its length and prevents electrical contact between conductor 21 and workpiece 11. At one end of that portion of workpiece 11 that is to be expanded, conductor 21 has a region with no insulation. Conductive bushing 31 fits around conductor 11 in that region in a manner so that there is good electrical contact between the sleeve and the conductor. Clamp 32, located around the exterior of workpiece 11, compresses the wall of workpiece 11 so that there is good electrical contact between the wall and bushing 31. At the other end of that portion of workpiece 11 that is to be expanded, conductive clamp 33 provides for the making of a good electrical connection between workpiece 11 and the remainder of the electrical circuit of the apparatus. Points 41 are the points where the remainder of the electrical circuit connect with the elements depicted in FIGS. 1 and 2.

Figure 3:
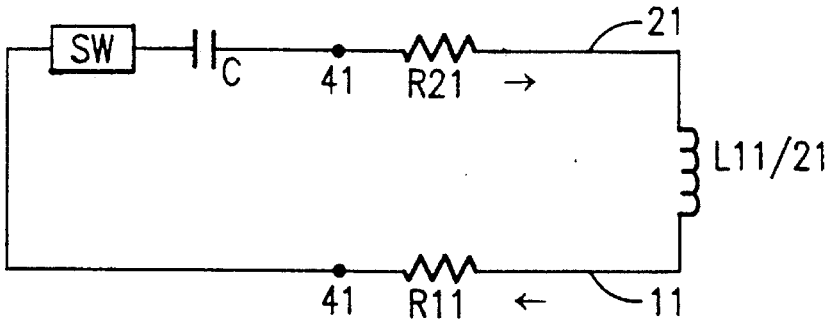
FIG. 3 is an electrical schematic diagram of the apparatus of a first embodiment of the present invention.

FIG. 3 depicts schematically the electrical circuit of the expansion embodiment of the present invention. Connected in series with elements 11 and 21, depicted in FIGS. 1 and 2, and described above are switching device SW and capacitor C. Device SW should be capable of handling a very high current. Suitable devices include a spark gap, an ignitron, a thyratron or a high power solid state semiconductor device.

To expand a tubular workpiece, one makes up the electrical circuit as described above, charges the capacitor to a voltage sufficient to produce the necessary current and magnetic field to expand the workpiece and operates the switching device to allow the capacitor to discharge through the circuit.

The magnetic field produced in conductor 21 is directed circumferentially over the length of workpiece 11 from bushing 31 to clamp 32. The current in workpiece 11 flows parallel to the axis of the tube and interacts with the magnetic field to produce a force perpendicular to the magnetic field and the current in the workpiece, that is, a force radially outward from the workpiece. It is because the current, indicated by the arrows in FIG. 3, flows in workpiece 11 and conductor 21 in opposite directions that the force on the workpiece is radially outward.

A portion of the initial voltage appears between the outer diameter of conductor 21 and workpiece 11 and produces a radial electric field. The thickness and dielectric strength of insulation 22 prevent electric discharge between conductor 21 and the inner wall of workpiece 11.

The duration of the pulse must be short enough that the workpiece does not overheat or melt. Thus the product of the square of the current, the resistance of the workpiece and the pulse duration must be less than the product of the mass of the workpiece, its specific heat and the temperature rise that would cause the workpiece to melt.

If the workpiece will expand into a surrounding conducting structure as would be the case, for example, of a tube expanding into the plate fins in a heat exchanger, the frequency of the pulse must be high enough to limit the magnetic skin effect depth to be on the order of or less than the thickness of the tube wall.

Figure 4:
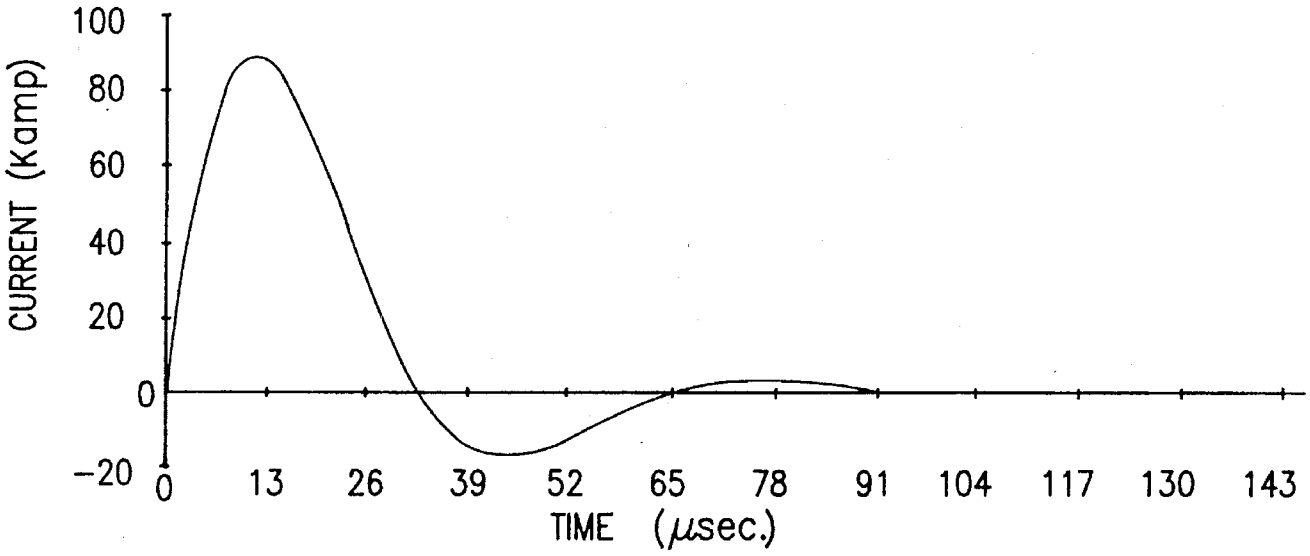
FIG. 4 is a graph of current versus time for a typical pulse generated by the electrical power source of the present invention.

FIG. 4 is a graph of current versus time for a typical current pulse in the circuit. The pulse contains a large burst of current in one direction followed by smaller bursts in alternating directions and decaying rapidly to zero. The circuit is a series RLC circuit in which capacitor C provides the capacitance, the parasitic resistances of the various components in the circuit, R11 and R21, provide the resistance and the configuration of workpiece 11 and conductor 21 provide the inductance, L11/21. The characteristics of the series RLC circuit control the frequency of the pulse. The desired pulse frequency can be attained by varying the values of capacitance, resistance and inductance in the components of the circuit or by adding additional resistors and inductors as necessary.

I have conducted tests, using an apparatus constructed according to the teaching of the present invention, to confirm theoretical predictions. One test was to expand a copper tube having a 7 millimeter outer diameter and a wall thickness of 0.24 millimeter to 109 percent of its initial diameter. The conductor was a copper rod having a 4.8 millimeter diameter. The electrical power source was a 400 microfarad capacitor, giving a discharge frequency of 15 kilohertz, charged to 4000 volts. Test results indicated that, for such an expansion operation, the peak current pulse must be on the order of 90,000 amperes. The pulse duration must be at least 10 microseconds but not more than 1200 microseconds. Where the tube will expand into aluminum plate fins, the pulse duration must be less than 100 microseconds. If polytetrafluoroethylene (Teflon®) is used as the insulator, the initial capacitor voltage must be no more than 9000 volts.

Figure 5:
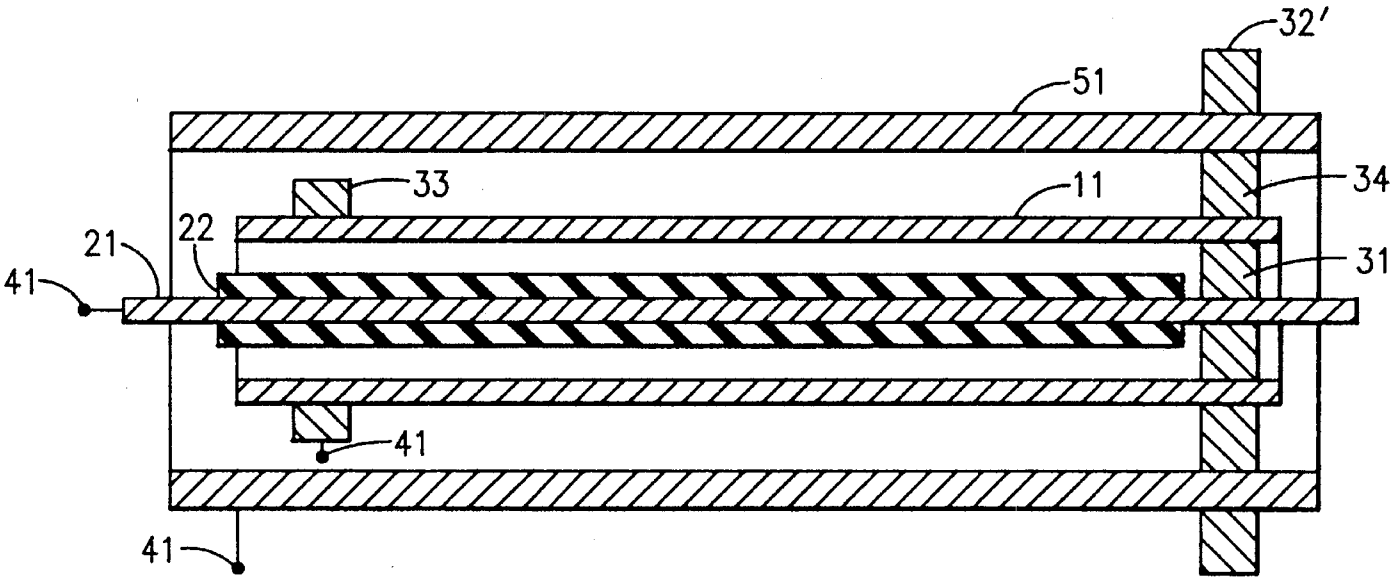
FIG. 5 is a sectioned elevation view of part of the apparatus of a second embodiment of the present invention.

FIG. 5 depicts, in a sectioned elevation view, part of the apparatus of the reduction embodiment of the present invention. Passing through tubular workpiece 11 is electrical conductor 21. Insulation 22 covers conductor 21 over most of its length and prevents electrical contact between conductor 21 and workpiece 11. At one end of that portion of workpiece 11 that is to be expanded, conductor 21 has a region with no insulation. Conductive bushing 31 fits around conductor 11 in that region in a manner so that there can be good electrical contact between the workpiece and the conductor. Outer electrically conductive tubular sleeve 51 extends around that portion of workpiece 11 that is to be reduced. Second conductive bushing 34 fits around workpiece 11 in a manner so that there can be good electrical contact between the workpiece and the sleeve. Clamp 32, located around the exterior of sleeve 51, compresses the walls of sleeve 51 and workpiece 11 and bushings 31 and 34 so that there is good electrical contact between these elements. At the other end of that portion of workpiece 11 that is to be expanded, conductive clamp 33 provides for the making of a good electrical connection between workpiece 11 and the remainder of the electrical circuit of the apparatus. Points 41 are the points where the remainder of the electrical circuit connect with the elements depicted in FIG. 5.

Figure 6:
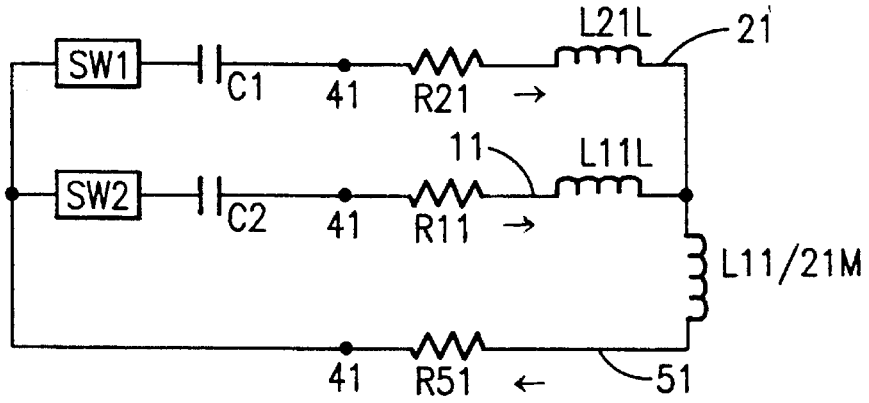
FIG. 6 is an electrical schematic diagram of the apparatus of a second embodiment of the present invention.

FIG. 6 depicts schematically one variant of the electrical circuit of the reduction embodiment of the present invention. Connected in series with elements 21 and 51, depicted in FIG. 5, and described above are switching device SW1 and capacitor C1. Connected in series with elements 11 and 51, depicted in FIG. 5, and described above are switching device SW2 and capacitor C2. The two series connected sets of elements are connected in parallel as shown in FIG. 6. Devices SW1 and SW2 should have similar capabilities and characteristics to those of device SW (FIG. 3). Devices SW1 and SW2 should be configured such that both will operate simultaneously. The circuit is a coupled RLC circuit which capacitors C1 and C2 provide the capacitance, the parasitic resistances of the various components in the circuit, R11, R21 and R51, provide the resistance and the configuration of workpiece 11, conductor 21 and sleeve 51 provide leakage inductances L11L and L21L and mutual inductance L21M. The characteristics of the RLC circuit control the frequency of the pulse. The desired pulse frequency can be attained by varying the values of capacitance, resistance and inductance in the components of the circuit or by adding additional resistors and inductors as necessary. The circuit components should be selected so that the pulse produced in the circuit is similar to that depicted in FIG. 4. The magnetic force produced in the apparatus of this embodiment is proportional to the product of the currents in the two legs of the reduction apparatus circuit. It is because the current, indicated by the arrows in FIG. 6, flows in workpiece 11 and conductor 21 are in the same direction that the force on the workpiece is radially inward.

Figure 7:
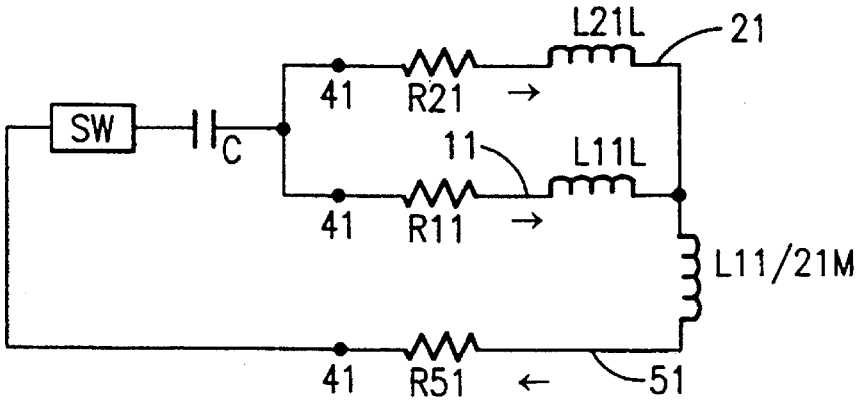
FIG. 7 is an electrical schematic diagram of the apparatus of a variant second embodiment of the present invention.

FIG. 7 depicts schematically another variant of the electrical circuit of the reduction embodiment of the present invention. In this circuit, there is only single switch SW and capacitor C to supply a current pulse to both a circuit leg containing workpiece 11 and a parallel circuit leg containing conductor 21. The current flows in the two legs are in the same direction as in the circuit depicted in FIG. 6 so that the force generated using this circuit variant is also radially inward. The other circuit components are the same as those shown in FIG. 6 and described above.

The electrical circuit of the apparatus of the present invention could also be a parallel RLC circuit. Such a circuit would require only minor modifications to the apparatus that are within the abilities of one skilled in the art.

For simplicity and clarity, the above drawings and description of the present invention address expanding or reducing a single, round straight tube equally in all directions. The method and apparatus of the present invention, however, are equally adaptable to reforming workpieces that are not straight, as for example the U-shaped "hairpin" tubes frequently found in plate fin and tube heat exchangers, nor round but rather oval or even square in cross section. And, by using more than one conductor passing through the workpiece, it is possible to reform a workpiece to a shape that is not the same as its original configuration, e.g. a tube having a circular cross section could be expanded to an oval cross section. The apparatus can be configured with multiple tubes in parallel being supplied with a single capacitor and switch or the apparatus could have multiple capacitors and switches. Sources of electrical energy not depending on a capacitor could be used.

I claim:

1. A method of reforming an electrically conductive tubular workpiece (11) between a first position (32) and a second position (33) on said workpiece comprising the steps of:

positioning an electrical conductor (21) within said workpiece;

making up an electrical circuit comprising
- a source of electrical energy (52),
- said electrical conductor, and
- said workpiece between said first position and said second position; and applying a current pulse through said electrical circuit, thereby generating a magnetic field about said workpiece and said conductor.

2. The method of claim 1 in which said conductor is insulated.

3. The method of claim 1 in which said electrical circuit is a series circuit.

4. The method of claim 1 in which said electrical circuit further comprises an electrically conductive sleeve (51) surrounding said workpiece between said first position and said second position.

5. The method of claim 4 in which said workpiece and said conductor are in parallel relationship in said electrical circuit.

6. The method of claim 5 in which said applying step further comprises applying simultaneous current pulses through that portion of said circuit that contains said conductor and through that portion of said circuit that contains said workpiece.

7. An apparatus for reforming an electrically conductive tubular workpiece between a first position and a second position on said workpiece comprising:

a conductor positioned within said workpiece;

an electrical circuit comprising
- a source of electrical energy,
- said electrical conductor, and
- said workpiece between said first position and said second position; and means for applying a current pulse through said electrical circuit, thereby generating a magnetic field about said conductor.

8. The apparatus of claim 7 in which said conductor is insulated.

9. The apparatus of claim 8 in which said electrical circuit is a series circuit.

10. The apparatus of claim 7 in which said current pulse applying means includes a capacitor (C) and a switching device (SW).

11. The apparatus of claim 7 in which said electrical circuit further comprises an electrically conductive sleeve (51) surrounding said workpiece between said first position and said second position.

12. The apparatus of claim 11 in which said workpiece and said conductor are in parallel relationship in said electrical circuit.

13. The apparatus of claim 12 in which said current pulse applying means further comprises means for applying simultaneous current pulses through that portion of said circuit that contains said conductor and through that portion of said circuit that contains said conductor.

14. The apparatus of claim 13 in which said current pulse applying means includes capacitors (C1 and C2) and switching devices (SW1 and SW2).

* * * * *